US007654858B2

(12) United States Patent
Geiger

(10) Patent No.: US 7,654,858 B2
(45) Date of Patent: Feb. 2, 2010

(54) INDICATOR LIGHT FOR CONNECTOR

(75) Inventor: Avi R. Geiger, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 11 days.

(21) Appl. No.: 11/705,191

(22) Filed: Feb. 12, 2007

(65) Prior Publication Data

US 2008/0195771 A1 Aug. 14, 2008

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS

| | | | | |
|---|---|---|---|---|
| 4,698,770 | A | 10/1987 | Rattan et al. | |
| 5,136,397 | A | 8/1992 | Miyashita | |
| 6,137,794 | A | 10/2000 | Brown et al. | |
| 6,241,550 | B1 | 6/2001 | Laity et al. | |
| 6,450,828 | B1 | 9/2002 | Gordon | |
| 6,657,548 | B2 * | 12/2003 | Dai | 340/815.45 |
| 6,772,265 | B2 | 8/2004 | Baweja et al. | |
| 7,093,942 | B2 | 8/2006 | Salvatori et al. | |
| 2002/0186325 | A1 | 12/2002 | Mears et al. | |
| 2005/0032415 | A1 * | 2/2005 | Sakamoto | 439/490 |
| 2005/0088620 | A1 | 4/2005 | Dwyer et al. | |
| 2005/0179873 | A1 | 8/2005 | Yamasaki et al. | |
| 2005/0264987 | A1 * | 12/2005 | Krancher et al. | 361/683 |
| 2006/0098123 | A1 | 5/2006 | Simkine | |

FOREIGN PATENT DOCUMENTS

EP 0830021 A2 3/1998

OTHER PUBLICATIONS

"Proxima Video/Computer Projector", http://www.vetmed.wsu.edu/depts-bcu/newsite/helps/PROXIMA.html.
"Using the Dell Laptop/NEC LT265 Projectors", http://hecs.rutgers.edu/projector/proj_direx.htm.

* cited by examiner

*Primary Examiner*—Ross N Gushi
(74) *Attorney, Agent, or Firm*—Krajec Patent Offices, LLC; Russell S. Krajec

(57) ABSTRACT

An illuminated connector for a device output may be used as a status indicator, showing various states of the output, including output on, proper functioning, and improper functioning. The illumination may be provided through a face of the physical connector, around a periphery of the connector, or proximate to the connector. Various colors and sequence of illuminations may communicate various states. The illuminator may be used to indicate the status of a wireless version of the same type of output of the connector.

18 Claims, 4 Drawing Sheets

100
SYSTEM WITH ILLUMINATED STATUS FOR VIDEO PORTS

300
RIGHT ANGLE CONNECTOR WITH INTEGRAL ILLUMINATION

INDICATOR LIGHT FOR CONNECTOR

BACKGROUND

Many electronic devices connect to other devices via physical connectors. For example, laptop computers may have a video output connector that can be connected to a video projector and music players may have an audio jack that connects to a set of headphones. In many such connections, a user may select that the interface is active or not through a separate user interface. In the case of a laptop computer, the user may select a feature that turns on a video output connector. In some devices, especially portable devices that run on battery power, a feature such as video output may consume unnecessary power.

SUMMARY

An illuminated connector for a device output may be used as a status indicator, showing various states of the output, including output on, proper functioning, and improper functioning. The illumination may indicate status for the connector interface as well as alternate ports for the same type of output, such as a wireless connection. The illumination may be provided through a face of the physical connector, around a periphery of the connector, or proximate to the connector. Various colors and sequence of illuminations may communicate various states.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
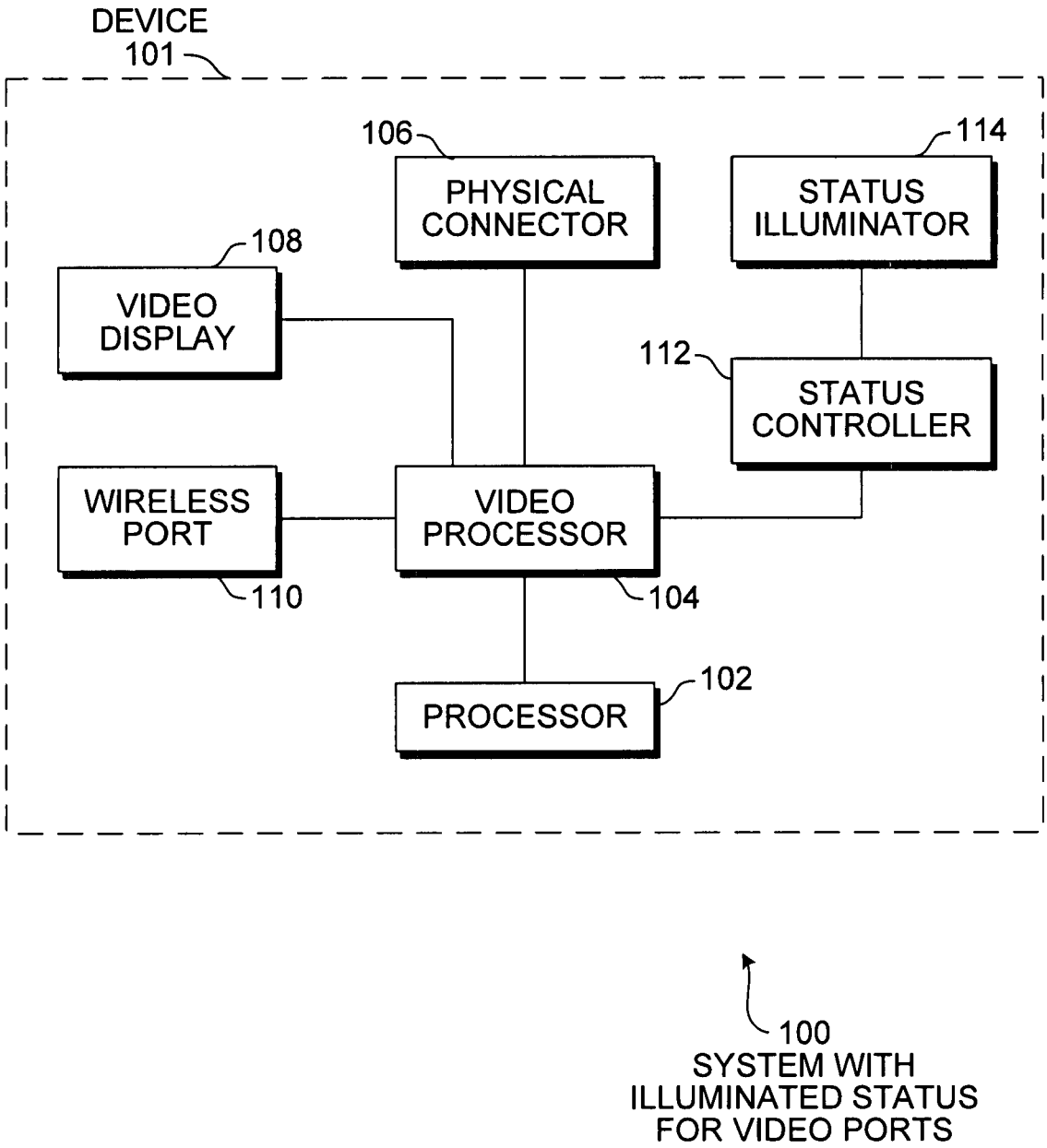
FIG. 1 is a diagram illustration of an embodiment showing a system with illuminated status for video ports.

A connector, such as a video connector, on a device may be illuminated to indicate various states of an output. The illumination may be illuminating a face of a connector, around a periphery of the connector, or an indicator proximate to the connector. The indicated status may be any state that is related to the connector or to an output that is represented by the connector. For example, an indicator on a video connector may be used to indicate status of any type of video output from a device, whether the output is through the physical connection to the connector or through a wireless connection or another physical connector.

Specific embodiments of the subject matter are used to illustrate specific inventive aspects. The embodiments are by way of example only, and are susceptible to various modifications and alternative forms. The appended claims are intended to cover all modifications, equivalents, and alternatives falling within the spirit and scope of the invention as defined by the claims.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

The subject matter may be embodied as devices, systems, methods, and/or computer program products. Accordingly, some or all of the subject matter may be embodied in hardware and/or in software (including firmware, resident software, micro-code, state machines, gate arrays, etc.) Furthermore, the subject matter may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. By way of example, and not limitation, computer readable media may comprise computer storage media and communication media.

Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by an instruction execution system. Note that the computer-usable or computer-readable medium could be paper or another suitable medium upon which the program is printed, as the program can be electronically captured, via, for instance, optical scanning of the paper or other medium, then compiled, interpreted, of otherwise processed in a suitable manner, if necessary, and then stored in a computer memory.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

When the subject matter is embodied in the general context of computer-executable instructions, the embodiment may comprise program modules, executed by one or more systems, computers, or other devices. Generally, program modules include routines, programs, objects, components, data structures, etc. that perform particular tasks or implement particular abstract data types. Typically, the functionality of the program modules may be combined or distributed as desired in various embodiments.

FIG. 1 is a diagram of an embodiment 100 showing a system with illuminated status for video ports. A processor 102 is connected to a video processor 104 that may generate a video signal. The video signal may be transmitted through a physical connector 106, a video display 108, or a wireless port 110. A status controller 112 may determine the video output status and illuminate a status illuminator 114 corresponding with the status.

The embodiment 100 may be any type of device that has an output port for a video signal. For example, the embodiment 100 may be a laptop computer, a personal digital assistant, a network appliance, a wireless device, or any other device having at least one output port for a video signal. A video signal may be transmitted to another device, such as a video projector, video display, a personal digital assistant, a general purpose computer, or any other device capable of receiving and displaying a video signal.

Throughout this specification, video signals are used as an example of the type of signals and connectors that may be coupled with an indicator to indicate the status of signals from a first connector as well as signals transmitted through a second connector or other output path. In other embodiments, the status of various audio output paths may be indicated by an illuminated indicator located proximally to a physical audio connector. Similarly, indicators may be associated with any type physical connector and may be used to indicate the status of signals on the connector as well as status of alternative output paths for the same or similar signals. For the purposes of illustration, video signals are used as an example of such a system within this specification. Those skilled in the art may readily apply the same principles to other types of signals, including audio, data, or other signals.

When a video signal is being transmitted through one or more of the various output ports, the status controller 112 may illuminate the status illuminator 114 to indicate the status. The status illuminator 114 may be located proximally to or integral to the physical connector 106 and comprise, for example, one or more light emitting diode ('LED') elements that may display one or more colors in a constant or blinking fashion. The illumination may indicate the status of any video signals present on the connector 106 as well as other ports to which video signals may be sent.

For example, when the video processor 104 has enabled a video signal to be transmitted to the physical connector 106, the status illuminator 114 may indicate a flashing green color. When a display device is properly attached to the physical connector 106 and operational, the status illuminator 114 may change to a constant green color.

In another example, the video processor 104 may enable a video signal to be transmitted over the wireless port 110, but not over the physical connector 106. The status controller 112 may cause the status illuminator 114 to indicate a blue color. Even though a video signal is not being transmitted through the physical connector 106, the status illuminator 114 attached to the video connector 106 may indicate the video status of the other port. A blue color indication may be used to indicate a wireless connection, and the fact that the physical connector 106 is a video connector may intuitively indicate to a user the status of a wireless video connection.

The status illuminator 114 may be used to indicate different status for different video ports. In some cases, a device may have two or more physical video ports, multiple wireless ports, or any other video port. An illuminator attached to one of the physical video ports may be used to indicate status for several different output paths or ports for a video signal. For example, a yellow indicator on or near a first connector may be used to indicate the status of signals in a second connector, while a green indicator may be used to indicate the status of signals in the first connector.

Users may become accustomed to a specific physical connector on a device as a video connector. For example, fifteen pin D-subminiature connectors or digital video interface ('DVI') connectors are examples of standardized video connectors that users may associate with video signals. A status illuminator that is visually associated with such a connector may be used to indicate any status associated with a video signal, regardless if the connector is being used to transmit the video signal. The status illuminator may use different colors, flashing sequences, alternating or changing color sequences, or any other technique to indicate a status for a video signal, even though the video signal may or may not be present on the connector.

The video processor 104 may be a portion of the device 101 that generates a video display signal. In some embodiments, the functions of a video processor 104 may be performed by a dedicated subsystem within the device 101 or some or all of the video display signal generation may be performed by a general purpose processor 102. In some embodiments, the processor 102 and/or the video processor 104 may be a general purpose processor adapted to execute various instructions, a state machine, gate array, a combination of hardware and software devices, or other configuration adapted to perform the function of generating a video display signal.

In some embodiments, a switch may be used to change between various output ports. Such a switch may be under programmable control from one or more the processor 102 or video processor 104. In other embodiments, such a switch may be a mechanical switch operated by a user.

The video display 108 may be a default output for a particular device. For example, a laptop computer or personal digital assistant may have an integrated video display 108 that is a default display. In some embodiments, the status illuminator 114 may be turned off when the default video display 108 is functioning normally and a video signal is not being sent to another port. In other embodiments, the status illuminator 114 may be used to indicate the status of the video display 108.

The wireless port 110 may be any type of non-physical connection between the device 101 and a display device. For example, the wireless port 110 may be an infrared connection, a Bluetooth connection, a connection over an IEEE 802.11 compliant connection, or any other connection that does not require a physical connector. In many implementations, a device may be capable of transmitting a wireless connection but a physical antenna or other transmitter may be hidden from a user. In such an implementation, a user may have no knowledge of where an antenna or transmitter may be located and no direct knowledge of the status of the wireless port. By using a specific color, sequence, or other unique illumination on a physical connector that is dedicated for video, the status of a wireless video connection may be made intuitively to a user.

The physical connector 106 may be any type of connector that may be used for video output. In many cases, such a 15 pin D-subminiature connector, DVI connector, or other standard interface. In some embodiments, the physical connector 106 may be an electrical connector, a fiber optic connector, or a combination of electrical and fiber optic. The connector 106 may include digital or analog signals. In some cases, the connector 106 may be shielded to mitigate radio frequency interference.

The status illuminator 114 may be a light emitting diode that is used to illuminate a portion of the physical connector 106 or otherwise be located proximally to the connector 106. The illuminator 114 may be capable of displaying one or more colors of various intensities and may have several separate illuminating elements.

In some embodiments, a portion of the physical connector 106 may be illuminated by using a light pipe or an integrated LED or some other design so that the physical connector itself emits light. In other embodiments, the status illuminator 114 may be located next to the connector 106 in a manner such that a user associates the indication with the connector. In still other embodiments, the status illuminator 114 may be located on a separate portion of the device 101 but with a graphic indicator associating the illuminator 114 with a video signal. In yet other embodiments, the status illuminator may be located such that the periphery of the physical connector 106 is illuminated.

The status controller 112 may be any type of state machine, software component, processor, or other device that is capable of detecting a status of a video signal and indicating the status on the status illuminator 114. In some embodiments, the status controller 112 may receive a status from the processor 102 or video processor 104. In other embodiments, the status controller 112 may perform a query to the processor 102 or video processor 104 or otherwise sense the status and presence of a video signal on one or more of the various ports.

Figure 2:
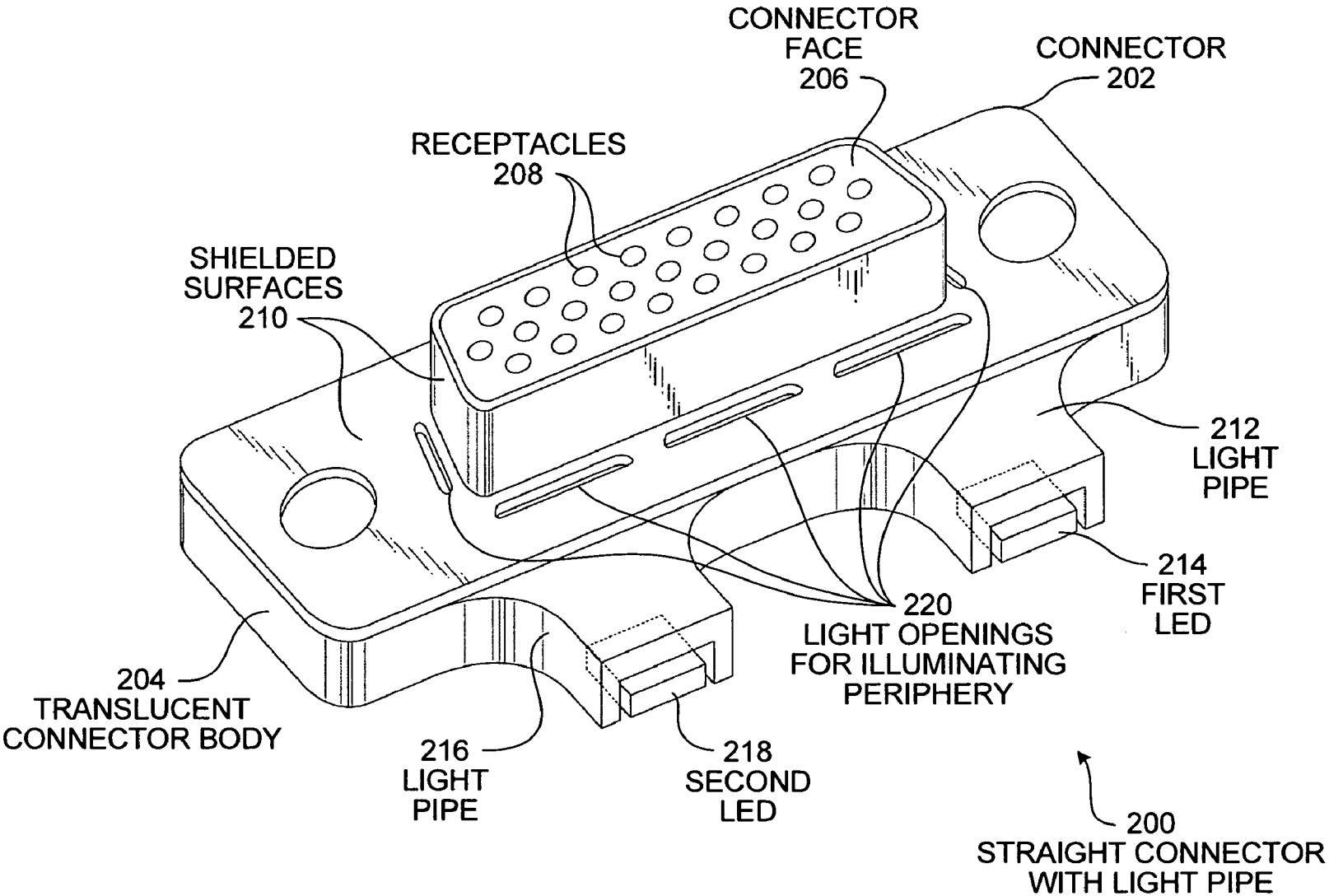
FIG. 2 is a pictorial illustration of an embodiment showing a straight connector with light pipes.

FIG. 2 is a illustration of an embodiment 200 showing a straight connector with a light pipe. The connector 202 has a translucent connector body 204, one end of which is a connector face 206 that contains various electrical receptacles 208. The connector 202 may be a typical 15 pin D-subminiature connector commonly used for video connections.

The connector 202 may have several shielded surfaces 210 for radio frequency shielding. The shielded surfaces 210 may be a formed metal surface or may have a conductive surface plated or otherwise applied.

The connector body 204 may have light pipes 212 and 216 that are positioned over a first LED 214 and a second LED 218, respectively. The connector body 204, being translucent, may collect light emitted from the LEDs 214 and 218 and conduct the light out the connector face 206. In some embodiments, light openings 220 may be provided around the perimeter of the portion of the connector 202 that may protrude through a faceplate of a device. The light pipes 212 and 216 may be configured in any manner so that light may be captured from one or more LEDs and illuminate the connector 202 or proximally to the connector 202 when installed.

The embodiment 200 is an example of a straight connector that may be mounted on a printed circuit board. The LEDs 214 and 218 may also be mounted on the same printed circuit board in a position such that the light pipes 212 and 216 are able to capture light from the LEDs. The embodiment 200 is an example of a design where the LEDs may be separate from the connector 202. Other embodiments may include the LEDs as an integrated component in the connector 202.

The connector 202 may be a typical D-subminiature connector, but may also be a DVI connector, a fiber optic connector, or any other connector from which video output may be transmitted. In some embodiments, the connector 202 may not have any shielding applied to the shielded surfaces 210, or may have shielding applied in different locations as a connector design may warrant. The connector 202 is illustrated as a receptacle or female connector. Other embodiments may have plug or male connectors or other types of contacts, including fiber optic contacts.

The connector body 204 may be any type of light-conducting material. In some instances, the connector body 204 may be a clear plastic material, while in other instances, the connector body 204 may be a tinted, semi-translucent, colorized, or other material that may conduct light from the LEDs 214 and 218 to the connector face 206 or through the openings 220. The material may be tinted or colorized so that any illumination from one or both of the LEDs 214 and 218 result in an appropriate colored illumination.

The connector 202 is illustrated with two LEDs 214 and 218. Various embodiments may have one, two, or more LEDs as desired. In some instances, two LEDs such as illustrated may be useful to provide uniform illumination across the connector face 206. In other embodiments, a first LED may provide one color while another LED may provide a second color. In still other embodiments, the LEDs may have multiple color elements.

In some embodiments, a flashing or pulsating illumination of the connector 202 may be performed by alternating the illumination of the first LED 214 and the second LED 218. In such embodiments, one LED may flash one color while another LED may flash another color in an alternating fashion.

Figure 3:
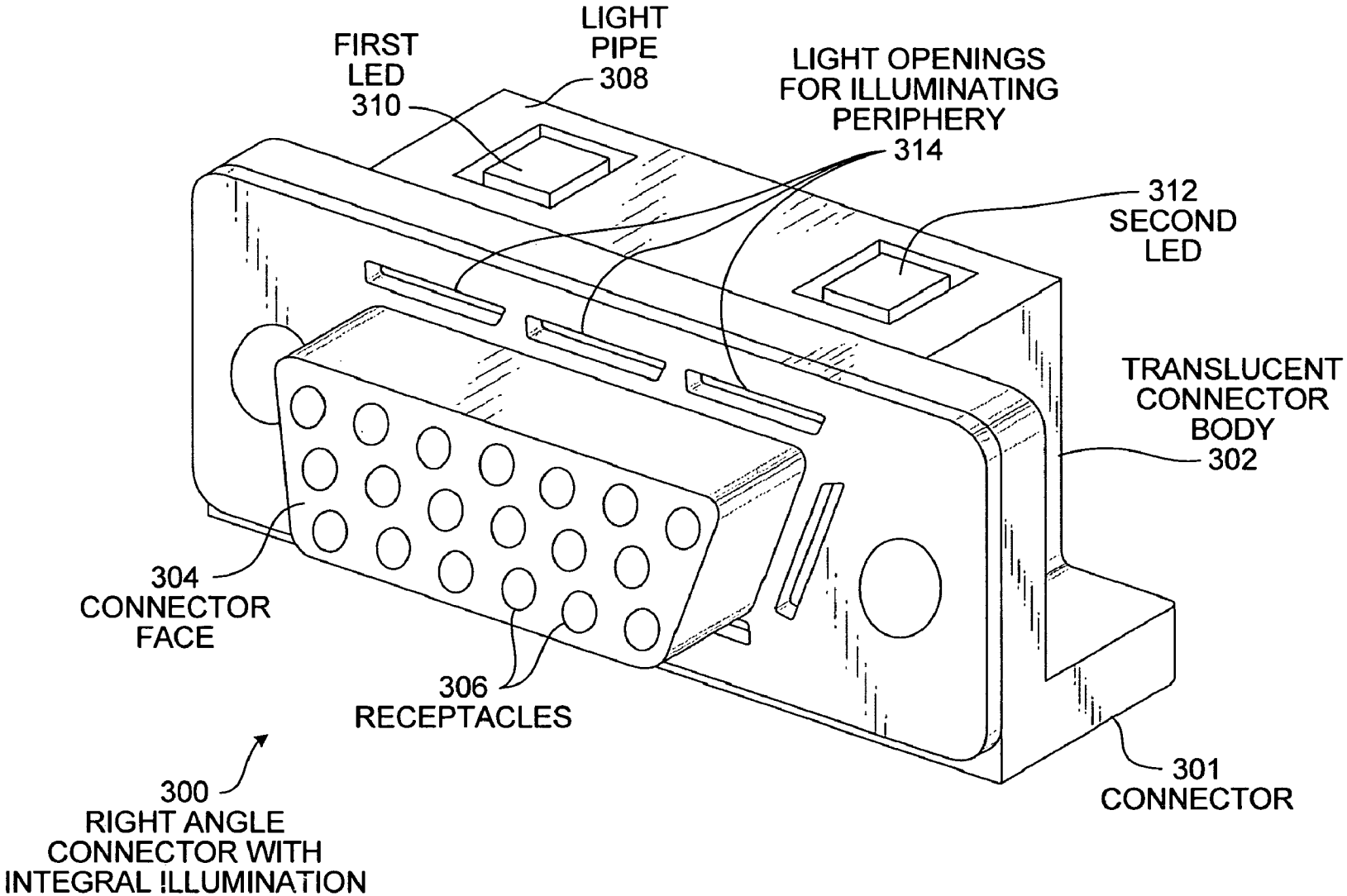
FIG. 3 is a pictorial illustration of an embodiment showing a right angle connector with integral light sources.

FIG. 3 is an illustration of an embodiment 300 showing a right angled connector with integral illumination. The connector 301 has a translucent connector body 302 that has a connector face 304 that contains receptacles 306. The connector 301 may be a 15 pin D-subminiature connector that may be used for video signals.

The translucent connector body 302 may include an integral light pipe 308 that contains integrally mounted LEDs 310 and 314. The LEDs 310 and 314 may be molded, attached, or assembled onto the connector body 302 as appropriate. The connector 301 may also include light openings 314 in any shielding that may be present so that the periphery of the connector may be illuminated.

Embodiment 300 is an example of an embodiment that contains integral LED or other light emitting components. Such an embodiment may be used to minimize part count when using separate light emitting components as in embodiment 200. The connector of embodiment 300 may be any type of connector, including DVI, analog, digital, radio frequency, coaxial connectors, fiber optic, or any other type of physical connector.

Figure 4:
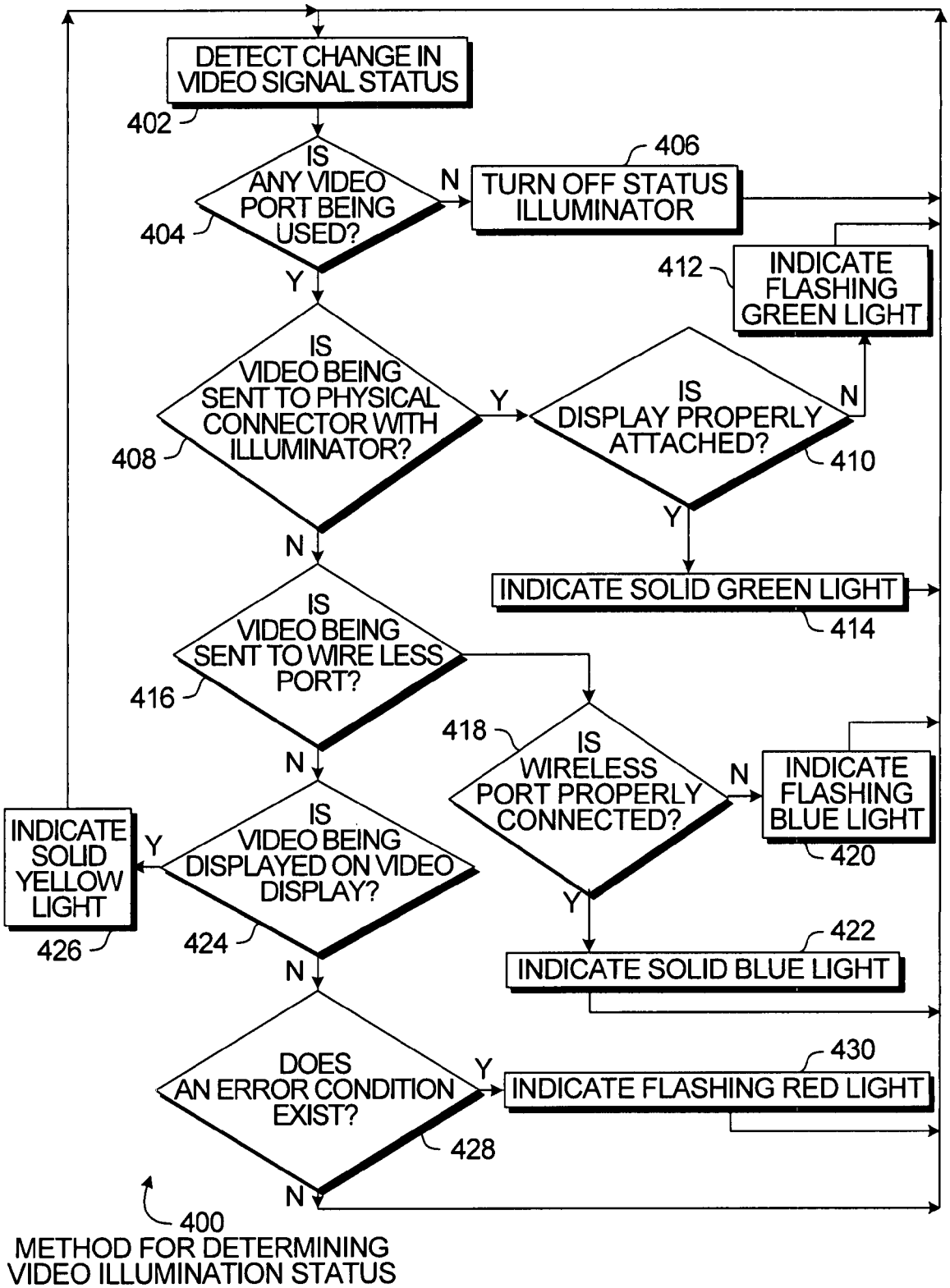
FIG. 4 is a flowchart illustration of an embodiment showing a method for determining a status and illuminating an indicator.

FIG. 4 is a flowchart illustration of an embodiment 400 of a method for determining a video illumination status. When a change in a video signal status is detected in block 402, the process begins.

If no video port is being used in block 404, the video illumination status is turned off in block 406 and the process returns to block 402.

If a video port is being used in block 404 and a video signal is being sent to the connector that has the video illuminator in block 408, and a display is not properly attached in block 410, a green flashing light is illuminated in block 412. The process returns to block 402.

If a video port is being used in block 404 and a video signal is being sent to the connector that has the video illuminator in block 408, and a display is properly attached in block 410, a continuous green light is illuminated in block 414. The process returns to block 402.

If the video signal is being sent to a wireless port in block 416, and the wireless port is not properly connected in block 418, a blue flashing light is illuminated in block 420. The process returns to block 402.

If the video signal is being sent to a wireless port in block 416, and the wireless port is properly connected in block 418, a continuous blue light is illuminated in block 422. The process returns to block 402.

If the video signal is being displayed on an integrated video display in block 424, a continuous or solid yellow light is illuminated in block 426. The process returns to block 402.

If an error condition exists in block 428, a flashing red light is illuminated in block 430 and the process returns to block 402. Otherwise, the process returns to block 402.

The embodiment 400 is one illustration of a scheme that may be implemented to provide different status indications on a video connector that has an illumination device attached or in proximity to the connector. By using different colors, flashing lights, or combination of the two, many different statuses may be displayed. The illumination may be able to communicate the status of different ports through which signals associated with the physical connector may be transmitted, even when those signals are not being transmitted through the physical connector.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A device comprising:

a physical video port having a physical connector, said physical video port configured to communicate video signals through said physical connector, said video signals being directly displayable on a video monitor;

a wireless port configured to communicate said video signals through a wireless communication medium;

an illuminator; and a controller configured to control transmission of said video signals through said physical video port and said wireless port, said controller being further configured to illuminate said illuminator in a first state when said video signals are being communicated through said physical video port, and to illuminate said illuminator in a second state when said video signals are being communicated through said wireless port.

2. The device of claim 1, said controller being configured to control transmission of said video signals by switching said video signals through one of said physical video port or said second port but not both said physical video port and said wireless port.

3. The device of claim 1 further comprising:

a display configured to display said video signals.

4. The device of claim 3, said controller being further configured to illuminate said illuminator in a third state when said video signals are being displayed on said display.

5. The device of claim 4, said controller being further configured to turn off said illuminator when said video signals are not being transmitted on either said first physical video port or said wireless port.

6. The device of claim 1, said first state being a first color and said second state being a second color.

7. The device of claim 1, said controller being further configured to turn off said illuminator when said video signals are not being transmitted through either said first physical video port or said wireless port.

8. The device of claim 1, said illuminator being located proximally to said physical connector.

9. A device comprising:

a physical video port having a physical connector, said physical video port configured to communicate video signals through said physical connector, said video signals being directly displayable on a video monitor;

a video display;

an illuminator; and a controller configured to control transmission of said video signals through said physical video port and said video display, said controller being further configured to illuminate said illuminator in a first state when said video signals are being communicated through said physical video port, and to illuminate said illuminator in a second state when said video signals are being communicated through said video display.

10. The device of claim 9, said controller being configured to control transmission of said video signals by switching said video signals through one of said physical video port or said video display port but not both said physical video port and said video display.

11. The device of claim 9, said second state being an unilluminated state.

12. The device of claim 9 further comprising:

a second port configured to communicate said video signals through a wireless communication medium.

13. The device of claim 9, said first state being a first sequence of illuminations and said second state being a second sequence of illuminations.

14. The device of claim 9, said illuminator being located proximally to said physical connector.

15. The device of claim 9, said controller being further configured to illuminate said illuminator to indicate an error condition.

16. The device of claim 9, said controller being further configured to:

illuminate said illuminator in said first state when said physical video port is transmitting said video signals to a video monitor connected to said physical video port; and illuminate said illuminator in a fourth state when said physical video port is configured to transmit said video signals to said second device, but when said second device is disconnected from said first port.

17. A device comprising:

a first physical video port having a physical connector, said physical video port configured to communicate video signals through said physical connector, said video signals being directly displayable on a video monitor;

a second physical video port configured to communicate said video signals to a second device;

a video display;

an illuminator located proximally to said physical connector; and a controller configured to control transmission of said video signals through said first physical video port, said second physical video port and said video display by switching each of said first physical video port, said second physical video port, and said video display;

illuminate said illuminator in a first state when said video signals are being communicated through said first physical video port;

illuminate said illuminator in a second state when said video signals are being communicated through said second physical video port.

18. The device of claim 17, said illuminator being a multicolor illuminator.

* * * * *

UNITED STATES PATENT AND TRADEMARK OFFICE

CERTIFICATE OF CORRECTION

PATENT NO. : 7,654,858 B2
APPLICATION NO. : 11/705191
DATED : February 2, 2010
INVENTOR(S) : Avi R. Geiger It is certified that error appears in the above-identified patent and that said Letters Patent is hereby corrected as shown below:

In column 8, line 3, in Claim 5, after "either said" delete "first".

In column 8, line 9, in Claim 7, after "either said" delete "first".

Signed and Sealed this
Eighth Day of February, 2011

David J. Kappos

David J. Kappos
*Director of the United States Patent and Trademark Office*